United States Patent [19]

Burton

[11] 4,329,931

[45] May 18, 1982

[54] BURNING SYSTEM AND METHOD

[76] Inventor: Robert E. Burton, 23881 Sherwood Rd., Willits, Calif. 95490

[21] Appl. No.: 121,536

[22] Filed: Feb. 14, 1980

[51] Int. Cl.[3] ..... F23G 5/12

[52] U.S. Cl. ..... 110/346; 110/255; 110/257; 110/259; 110/290

[58] Field of Search ..... 110/289, 290, 291, 257, 110/229, 230, 231, 255, 227, 259, 346, 347

[56] References Cited

U.S. PATENT DOCUMENTS

| | | | |
|---|---|---|---|
| 3,559,823 | 2/1971 | Ostrin | 110/109 X |
| 3,595,546 | 7/1971 | Uzdavines | 110/257 X |
| 3,668,077 | 6/1972 | Ban | 110/257 X |
| 3,744,145 | 7/1973 | Maxwell et al. | 110/227 X |
| 3,855,950 | 12/1974 | Hughes et al. | 110/255 X |
| 4,172,425 | 10/1979 | Sheridan | 110/291 X |

*Primary Examiner*—Edward G. Favors
*Attorney, Agent, or Firm*—Flehr, Hohbach, Test, Albritton & Herbert

[57] ABSTRACT

A substantially smokeless burning system for burning waste material fuels. An elongated hollow burning chamber is supported in a generally horizontal orientation with a slight degree of upward tilt from front to rear. An elongated fuel accumulation chamber and a hydraulic hoist driven ram in the chamber are adapted to push elongated volumes of new fuel into the lower front end of the burning chamber such that already burning fuel is pushed to the rear of the chamber. This establishes a charcoal burning zone which at least partially overlies a volatile burning zone such that incomplete combustion products from the volatile burning zone pass over and through the charcoal burning zone to be substantially burned before exiting at the rear of the burning chamber. The burning chamber is formed of a plurality of pipe sections which are molded of refractory material in a concrete pipe making machine. Integral preheat and air delivery channels are formed in the walls of the burning chamber during the molding process.

22 Claims, 10 Drawing Figures

BURNING SYSTEM AND METHOD

This invention relates in general to burning systems and methods, and more specifically, to burning systems and methods for burning a variety of fuels in a substantially smokeless manner.

In many localities there are large quantities of waste materials, such as wood scraps, bark, underbrush, wheat straw, etc., which could be used as fuel if a burning system were available to burn the materials in compliance with local air pollution standards. Even in rural areas, it is required that incinerators and other burning systems operate in an essentially smokeless manner and emit combustion gases of various types and particulates in concentrations less than mandated levels. Most localities in the United States require that burning systems emit a level of smoke less than a Ringleman rating of 1, which means, neglecting steam and water vapor, only very slight wisps of smoke are visible to the eye. The above-mentioned materials often have a substantial moisture content and are difficult to burn without emitting substantial smoke.

The burning of unseasoned wood scraps and other fuels having a substantial water content is a three-step process that proceeds sequentially. As the fuel is brought to the ignition temperature (about 400° F. for wood), water vapor is given off as the fuel goes through a drying phase. As the fuel starts to burn, combustible gases and unburned carbon particles are given off in the form of smoke. This can be called the volatile burning phase. Later the fuel enters a charcoal phase wherein the fuel is burning at a much higher temperature and very little water vapor, combustible gases and unburned carbon are emitted. Subsequently, the fuel enters the ash phase wherein substantially all of the combustible portions of the material have been burned, leaving a generally uncombustible residue.

Prior art systems have generally taken a variety of approaches to burning fuels with substantial moisture content in a substantially smokeless manner. A first approach generally involves the use of an afterburner compartment or section which the volatile gases and unburned carbon particles emanating from the burning material pass through and are substantially burned before exiting through a flue or chimney. This afterburner approach involves either a passive system in which the afterburner structure is heated by the combustion heat from the burning material itself, or is an active system utilizing supplemental fuel for burning the volatile gases and unburned carbon particles in a secondary burning process.

Systems such as those disclosed in U.S. Pat. Nos. 3,456,603, 3,408,167 and 3,380,410 exemplify this afterburner approach.

A second approach involves extending the transient time of the fuel in the combustion zone, i.e., the area where the temperature in the burning chamber is above 500° F., while providing sufficient combustion air (oxygen) to the combustion zone. The second approach is exemplified by Glaeser U.S. Pat. No. 2,483,728 and Berg U.S. Pat. Nos. 2,783,776 and 2,800,093. The systems disclosed in each of these patents generally involve provision of combustion air to the burning chamber tangentially to the flow of pulverized or comminuted fuel into the chamber in order to create a swirling motion of the fuel. This results in longer transient time for the fuel in the combustion chamber, and the swirling air tends to throw unburned particles against the walls where they can then drop back into the burning zone. Since one of the purposes of systems for burning waste materials is the conservation of energy resources, as well as eliminating the need for other, environmentally-unsound methods of waste disposal, the requirement that the fuel be in a comminuted or finely divided form detracts from the value of such systems since substantial energy is required for bringing most waste materials into such a finely divided form. Furthermore, the prior art systems referred to above, generally utilize a complex burning chamber and air delivery system requiring separate auxiliary ducting systems for providing the combustion air to the jet structure for producing the swirling air currents in the burning chamber.

A third approach involves feeding new fuel into the burning chamber underneath the already burning fuel. This is generally accomplished by using a conveyor such as a screw conveyor to feed fuel into the bottom of a vertical burning chamber so that the volatile gases and unburned particles will be burned in passing through a vertically adjacent zone in which material is burning in a charcoal phase. Systems employing this approach in a vertical burning chamber are only partially successful since the volatile gases tend to pass quickly through the upper charcoal burning zone. Furthermore, a screw conveyor requires that the fuel be comminuted or pulverized, since other forms of fuel cannot be pushed around a bend to enter the burning chamber. Finally, a screw conveyor system involves substantial risk of flashback of the fire into the conveyor where it may ultimately reach the fuel supply and end up damaging the burning system. It can thus be seen that a simple and trouble-free, smokeless burning system is not available in the prior art.

Accordingly, it is an object of this invention to provide a burning system of simple construction which can burn a variety of fuels in a substantially smokeless fashion.

It is a further object of this invention to provide an efficient method of burning a variety of fuels in uncomminuted form with a minimum of smoke.

Another object of this invention is to provide a burning chamber of simple construction and a simplified method of forming a burning chamber.

This invention generally features a substantially smokeless burning system which utilizes an elongated burning chamber supported in a generally horizontal orientation with a slight degree of upward tilt from front to rear. A feeding means is provided for pushing an elongated volume of new fuel (i.e. a volume of fuel having substantial longitudinal strength) into a lower front end of the burning chamber, simultaneously pushing previously introduced, already-burning fuel toward the rear of the burning chamber to establish a fuel drying zone extending across a lower front portion of the chamber, a volatile burning zone adjacent to and substantially overlying the fuel drying zone in a generally central portion of the chamber, and a charcoal burning zone adjacent to and substantially overlying the volatile burning zone in a generally rear portion of the chamber. Air delivery means is provided for supplying air to the interior of the chamber at a plurality of locations across at least substantially the total length of said chamber. Incomplete combustion products from the volatile burning zone pass through and across the charcoal burning zone and are substantially completely burned therein before exiting the rear end of the chamber.

In a preferred embodiment, the burning chamber comprises a generally hollow body formed of a refractory material and the support means comprises a pair of support beams carrying the burning chamber and a support structure carrying the support rails at a slight angle. The feeding means comprises an elongated fuel accumulation chamber which communicates with the lower front end of the burning chamber and is adpated to receive fuel to be burned. A feeding ram is carried in the fuel accumulation chamber and is adapted to push material therein into the burning chamber. A driving means is provided for driving the feeding ram to deliver the material into the burning chamber. In the preferred embodiment, the air delivery means comprises at least one channel formed in a wall portion of the hollow body and extending across at least substantially the total length thereof. A plurality of air delivery ports are located at intervals along substantially the total length of the channel to connect the channel with the interior of the hollow body. An external opening in the channel is adapted to be connected to an air supply means for delivering air to the interior of the hollow body through the channel and air delivery ports.

In accordance with another aspect, the invention features a method for burning combustible material with a minimum of smoke which begins with the step of disposing an elongated, substantially-closed burning chamber in a substantially horizontal orientation with a predetermined slight degree of upward tilt from front to rear. The next step is to furnish a continuous supply of combustion air to the interior of the burning chamber at regular intervals across the total length of the chamber. The method continues with establishing a first elongated volume of fuel burning in a substantially smokeless, charcoal burning phase across an extended lower region of the burning chamber. Next, a second elongated volume of fuel is pushed into a lower front region of the burning chamber at least partially underneath the first volume of fuel to initiate combustion of the second volume of fuel in a volatile burning phase which produces volatile gases and unburned combustible particles. The volatile gases and unburned combustible products from the second volume of fuel are passed through and over the first volume of fuel in the burning chamber to be substantially completely burned before exiting the burning chamber.

This invention also features an elongated burning chamber having a first end defining a fuel entry port and a second end defining a flue port. The burning chamber comprises a generally hollow body formed of a refractory material, at least one channel formed in a wall of the hollow body and extending across a substantial portion of the length of the body, and a plurality of ports formed between the channel and the interior of the body. The channel is adapted to be connected to an air delivery means to deliver combustion supporting air to the interior of the chamber through said ports.

The invention also features a method for forming an elongated burning chamber with an intergral combustion air delivery channel. This method involves the steps of molding a plurality of individual cylindrical pipe sections from a refractory material with at least one channel integrally formed in a predetermined portion of the wall of each pipe from one end of the pipe to the other. A plurality of ports are formed between the channel in each pipe section and an interior wall of the pipe section, and then the pipe sections are assembled together in end-to-end relation with the channels in the wall sections substantially aligned.

The burning apparatus and method of this invention have the advantage of enabling the virtually smokeless burning of a wide variety of fuels, including a variety of waste materials such as scrap wood, underbrush, bark, sawdust, wheat straw, etc. The fuels do not have to be and are preferably not comminuted (i.e., pulverized or chopped up) because individual fuel charges are accumulated in a elongated feeding chamber and then rammed into the elongated burning chamber with a hydraulically driven ram. This feeding action together with the slight incline of the burning chamber causes the new fuel having substantial longitudinal strength to push the already burning fuel toward the rear of the burning chamber, but also pushes the new fuel at least partly underneath the already burning fuel. This advantageously creates the two adjacent volatile and charcoal burning zones, with the charcoal burning zone overlying the volatile burning zone such that volatile gases and unburned particles must pass either through or over the charcoal burning zone and are thus burned in a substantially complete manner before exiting the chamber.

The burning system of this invention has a further advantage of being of simplified construction. This simplified construction is provided by the use of a burning chamber with combustion air channels integrally formed in the side walls of the chamber. In addition, the burning chamber is formed by molding a plurality of pipe sections out of the refractory material of the chamber with the air channels integrally molded into the side walls of the pipe sections. The pipe sections can then be assembled together end-to-end with the channels substantially aligned to form this simplified burning chamber. By utilizing existing pipe section molding apparatus typically used for the molding of concrete sewer pipe sections, the burning chamber of this invention can be constructed very economically of high quality refractory material. This avoids the high labor costs involved with building burning chambers with individual bricks of refractory material. It also avoids the complexity of metal burning chambers which require surrounding water jackets to keep the chamber walls from melting. The integrally formed air delivery channels avoid the expense of labor and material in providing separate ducting structures for supplying combustion air to the interior of the chamber.

The rugged, simple construction and operation of the burning system according to this invention enables it to be readily utilized in an outdoor environment and it is especially suited for providing the large amounts of heat required in the making of asphalt paving materials or the manufacture of Portland cement. The burning system can readily be operated and tended by one person and does not require any sophisticated control or automatic feeding mechanisms for maintaining optimal operation of the system.

Other features and advantages will be apparent from a consideration of the following detailed description of an exemplary preferred embodiment of the invention in conjunction with the accompanying drawings.

Figures 1, 2:
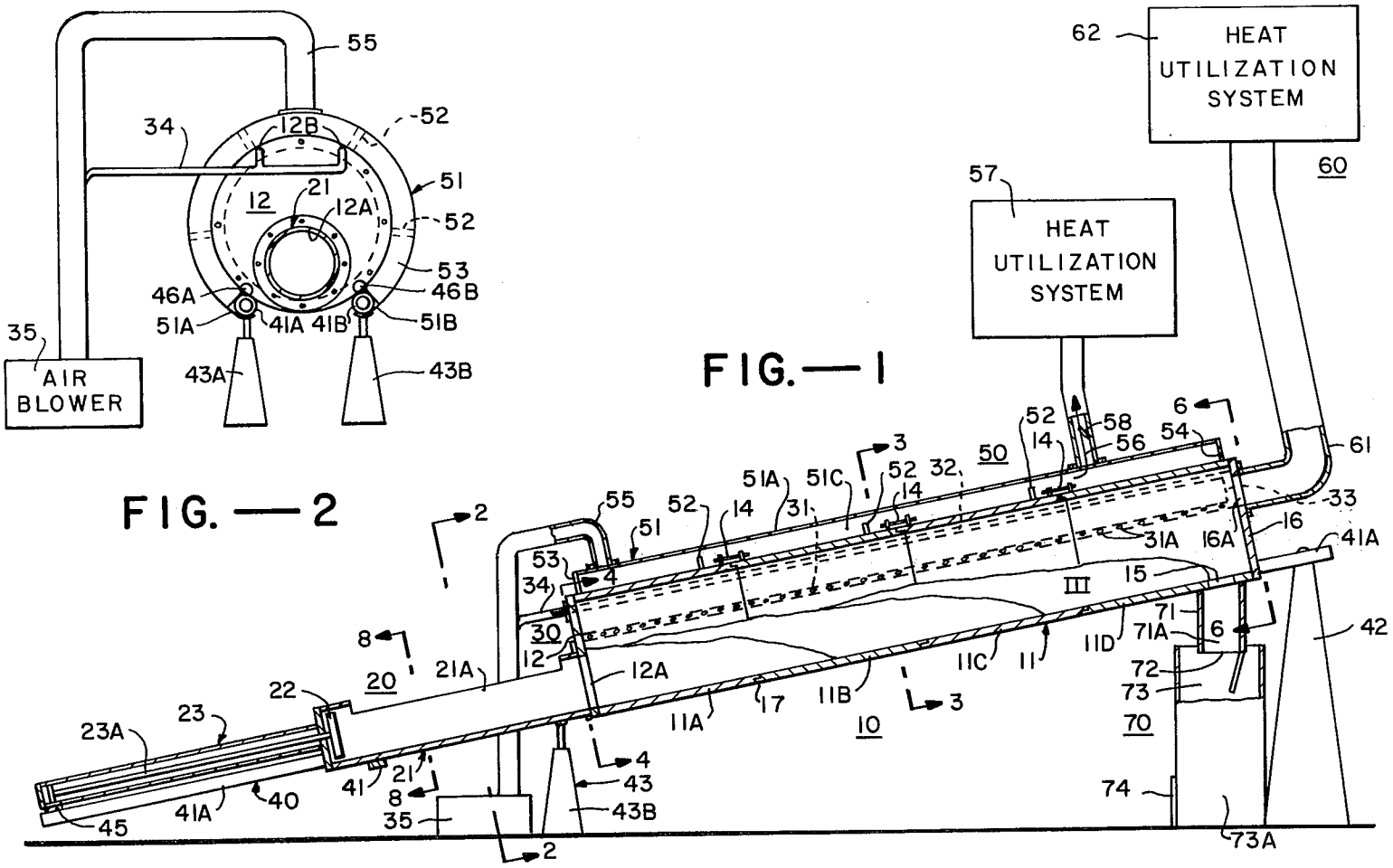
FIG. 1 is generally a cross-section view of a burning system in accordance with this invention.
FIG. 2 is an elevational front view taken along the lines 2—2 in FIG. 1.

The general overall structure of a burning system in accordance with this invention is depicted in FIGS. 1 and 2. The major components of the preferred burning system are an elongated burning chamber 10, a fuel feeding system 20, a combustion air delivery system 30, a support structure 40, and a shield arrangement 50. A shield arrangement 50 is shown on burning chamber 10 to shield burning chamber 10 against moisture from rain or snowfall (if used outdoors) and to insulate the walls of the burning chamber 10 to maintain an optimum heat distribution thereacross. FIG. 1 also shows a heat utilization system system 57 communicating with the shield arrangement 50 and a second heat utilization system 60 communicating with the combustion gas exit end of burning chamber 10.

As shown in FIGS. 1 and 2, burning chamber 10 comprises a generally hollow cylindrical body 11, a front wall 12, and a rear wall 16. The hollow cylindrical body 11 is made up of a plurality of individual sections 11A–11D. These individual sections are fastened together with clamping arrangements 14. The front wall 12 of burning chamber 11 has a fuel entry port 12A therein, as well as a combustion air delivery port 12B. The back wall 16 has a combustion gas exit port 16A therein. A small opening 15 is formed in the bottom of cylindrical body 11 to drop ash and charcoal out of the interior of the burning chamber 10. The specific structural details of burning chamber 10 will be described later.

The fuel feeding arrangement shown in FIG. 1 comprises essentially a fuel accumulation chamber 21, a feeding ram 22 carried in fuel accumulation chamber 21 and a driving means 23 for driving the feeding ram 22. As shown, fuel accumulation chamber 21 is an elongated, hollow cylindrical body with an elongated top opening 21A through which fuel can be placed in chamber 21. Feeding ram 22 is adapted to traverse the interior of accumulation chamber 21 to push an elongated volume of fuel (i.e. one having substantial longitudinal rigidity or strength) into fuel entry port 12A in the front wall 12 of burning chamber 10. The driving arrangement 23 shown in FIG. 1 is a hydraulic cylinder with its piston 23A attached to feeding ram 22. As will be described in detail, this hydraulic cylinder is a double acting cylinder for driving feeding ram 22 toward the fuel entry port 12A and withdrawing the feeding ram 22 to the front of chamber 21. Specific details of the construction and operation of the feeding arrangement 20 will be given later in conjunction with FIGS. 8 and 9 of the drawings.

The combustion air delivery system as shown in FIGS. 1 and 2 generally comprises a first pair of channels 31 formed in the side walls of the cylindrical body 11 of substantially burning chamber 10, a second pair of channels 32 formed in the side walls of hollow body 11, a plenum arrangement 33 formed at the rear end of hollow body 11, air delivery ducting 34 communicating with channels 32 through air delivery ports 12B in front wall 12 of burning chamber 10, and an air blower 35 for supplying air to the ducting 34. In operation of the burning system, the air delivered by fan 35 through the ducting 34 to channel 32 will be preheated in channels 32 as it flows from the front to the back of that channel. This preheated air will be delivered through plenum 33 to channels 31. The preheated air will then flow through air delivery ports 31A to provide overdraft air to the fire burning in burning chamber 10.

A preferred support structure 40 for the burning system shown in FIGS. 1 and 2 comprises a pair of steel pipe support beams 41A and 41B, a rear pylon 42 supporting generally one end of beams 41A and 41B and a jacking arrangement 43 shown as comprising a pair of hydraulic hoists 43A and 43B. As shown in FIG. 2, burning chamber 10 is carried on the support beams 41A and 41B. Stop blocks 46A and 46B are attached in any appropriate fashion to the support beams 41A and 41B for retaining burning chamber 10 in position on support beams 41A and 41B. The use of a jacking or hoist arrangement 43 enables the angle of upward tilt of burning chamber 10 to be adjusted. Generally, the degree of upward tilt for burning chamber 10 will be in the range of about nine degrees to fifteen degrees. It is believed preferable, generally, to utilize a shallower angle of tilt, both to reduce the possibility of burning material falling back into fuel accumulation chamber 21 and to increase the residence time of combustion gases in combustion chamber 10 before exiting through flue or chimney arrangement 61. It will be appreciated by those skilled in the art that numerous other supporting arrangements could be provided for burning chamber 10. The provision of an adjustable upward degree of tilt to the burning chamber is not essential and, instead, one or more additional pylons could be provided near the front of burning chamber 10 to support it at a fixed degree of upward tilt. In some instances, however, where different types of fuel materials will be burned, it may be advantageous to be able to adjust the upward tilt to provide optimum burning of different types of material.

The shield arrangement 51 shown in FIGS. 1 and 2 includes a hollow cylindrical side wall section 51A which surrounds a major portion of the exterior cylindrical surface of burning chamber 10. In particular, as shown in FIG. 2, this cylindrical side wall section 51A extends from support beam 41A and 41B around the side and upper wall portions of burning chamber 10. A plurality of supports 52 maintain the spacing between side wall section 51A of shield 51 and the outer surface of hollow body 11. Front and rear end wall sections 53 and 54 of shield 51 extend down to the outer surface of hollow body 11. In this manner, shield 51 forms a heating chamber 51C surrounding the exterior walls of hollow body 11. An air delivery duct 55 may be utilized to supply air to be heated in heating chamber 51C formed between walls 51A of shield 51 and the exterior wall of burning chamber 10. FIG. 1 shows a heat withdrawal port 56 communicating with the interior of the heating chamber 51C for withdrawing heat from the heating chamber to deliver it to a heat utilization system 57. A manually controlled flapper valve 58 may be utilized to control when the heat will be withdrawn from heating chamber 51C. As will later be discussed, this valve is maintained closed during the start-up operation of the burning chamber 10 to permit an initial, more rapid heat up of the walls of hollow body 11. The relatively modest amounts of heat provided by withdrawing heated air from heating chamber 51C could be utilized, for example, for drying lumber. Alternatively, this heated air could be recirculated into the combustion air supply arrangement 30 for an intial preheating of the air before supplying it to the preheating channels 32 in the walls of hollow body 11.

The primary heat utilization arrangement 60 involves withdrawing combustion gases from the interior of hollow body 11 through a flue or chimney arrangement 61 into a heat utilization system 62. This heat utilization system 62 may be, for example, a steam generating type of heat exchanger unit. Alternatively, the hot combustion gases from the interior of burning chamber 10 may be used directly to heat the material in a retort which is utilized for manufacture of asphalt paving material or Portland cement.

FIG. 1 also shows a charcoal recovery system 70 which communicates with the opening 15 in the bottom of burning chamber 10. Recovery system 70 comprises an intial ash and charcoal collection chamber 71 into which ash and charcoal drop as they are pushed toward the rear of burning chamber 10. After a volume 71A of charcoal is collected, the flapper valve 72 is opened to drop the ash and charcoal 71A into an air-tight quenching chamber 73 where the burning charcoal will be extinguished due to the lack of combustion supporting oxygen. A door 74 is provided in the quenching chamber 73 to withdraw extinguished ash and charcoal therefrom at regular intervals. The charcoal may then be separated from the ash and utilized for a variety of commercial purposes.

FIGS. 3 through 9 depict in greater detail the structure and features of a preferred version of a burning system in accordance with this invention. In describing this preferred system, a series of reference numerals 100 through 500 will be utilized and, generally, be keyed to reference numerals 10 through 50 utilized in conjunction with FIG. 1. The higher series of reference numerals will be utilized in order to have more numbers available to identify in greater detail the structural features of the preferred embodiment.

Figure 3:
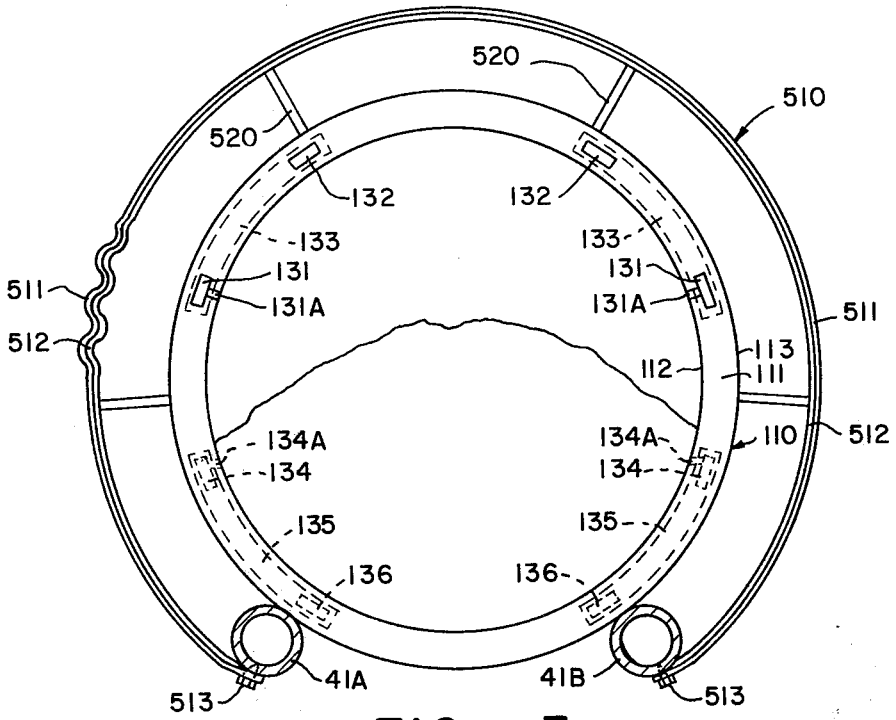
FIG. 3 is a front view of the burning chamber taken along the lines 3—3 in FIG. 1.

Referring first to FIGS. 3 through 7, the specific structural details of a preferred burning chamber and shield arrangement will be described. Consider first the cross-sectional configuration of a preferred burning chamber as shown in FIG. 3. Burning chamber 110 is a hollow cylindrical body 111 which, as will later be discussed in detail, is preferably molded of a preselected refractory material such as a castable hydraulic setting refractory concrete sold by Kaiser Refractory Materials under the tradename Sakonite.

Figure 7:
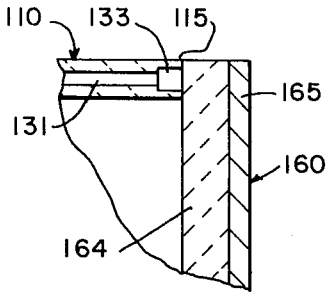
FIG. 7 is a partial section view taken along the lines 7—7 in FIG. 6.
Figure 6:
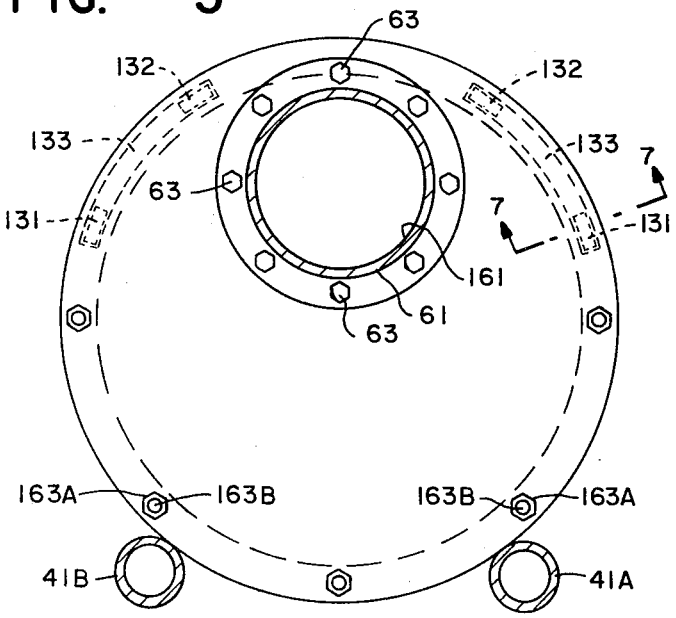
FIG. 6 is a rear elevation view taken along the lines 6—6 in FIG. 1.

A pair of air delivery channels 131 are shown formed in opposite upper side wall portions of the cylindrical body 111. As shown in FIG. 1, these channels 131 extend the complete length of hollow body 111 from front to rear. Air delivery ports 131A are formed between interior wall 112 of hollow body 111 and channels 131. A second set of channels 132 are formed in another upper wall section of hollow body 111 and similarly extend the full length of burning chamber 110 as shown in FIG. 1. Channels 132 serve as air preheating channels and communicate with air delivery channels 131 via a pair of plenums 133 formed in a rear wall of the burning chamber 110. Referring briefly to FIGS. 6 and 7, it can be seen that plenums 133 are formed in end wall 115 by forming channels 133 therein which are covered by the rear wall 160. During operation of burning chamber 110, the heat contained in the cylindrical walls of body 111 is utilized to preheat the air flowing through the channels 132. As this preheated air reaches plenums 133, it is communicated to the combustion air delivery channels 131 and finally into the interior of combustion chamber 110 through the air delivery ports 131A. In this fashion, the combustion air delivery system comprising the preheating channels and the return combustion air delivery channels is integrally formed in the walls of the hollow body 111 itself.

As shown in FIG. 3, underfire air delivery channels 134 may optionally be formed in a lower wall section of cylindrical body 111 with air delivery ports 134A communicating between channels 134 and the interior of hollow body 111. In this case, a separate set of preheat channels 136 may also be provided in a lower wall section of body 111 in order to carry air from one end of the burning chamber to the other to be preheated before being communicated via plenums 135 to air delivery channels 134. It will be noted that the air delivery ports 134A formed for delivering the preheated underfire air to the interior of burning chamber 110 are configured at an angle to make it more difficult for ash and other residues to enter and clog the air delivery ports.

FIG. 3 also shows the details of the preferred shield arrangement 510 surrounding combustion chamber 110. This preferred shield arrangement comprises a layer of sheet metal 511 formed to a generally cylindrical shape and fastened to the support rails 41A and 41B with any appropriate fastening means such as screws 513. For rigidity, the layer of sheet metal 511 is preferably a corrugated layer as shown. In addition, a plurality of braces 520 are mounted between the shield 511 and the exterior wall 113 of hollow body 111. A layer of sprayed foam insulation 512 is preferably formed on the interior of the corrugated sheet metal wall 511 in order to provide better thermal insulation for the heating compartment 514 formed between shield 510 and the outer wall 113 of burning chamber 110.

Figure 4:
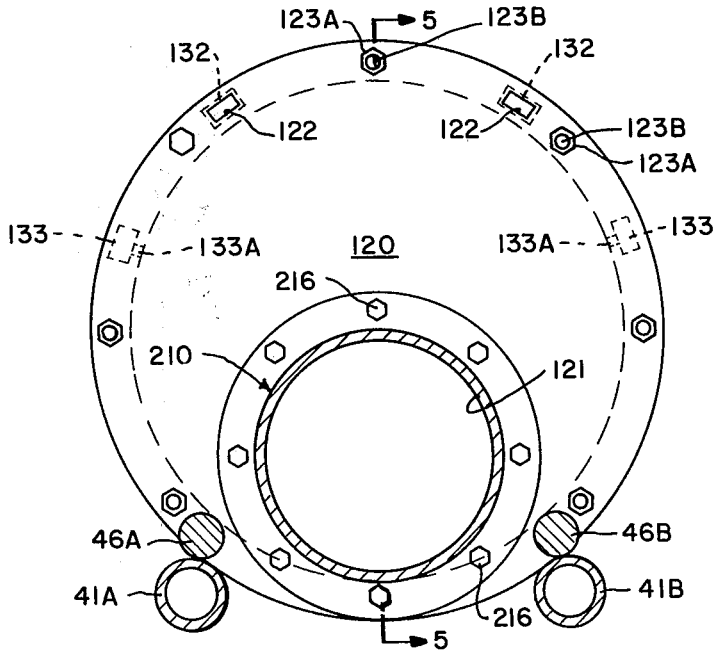
FIG. 4 is a partial section view taken along the lines 4—4 in FIG. 3.
Figure 5:
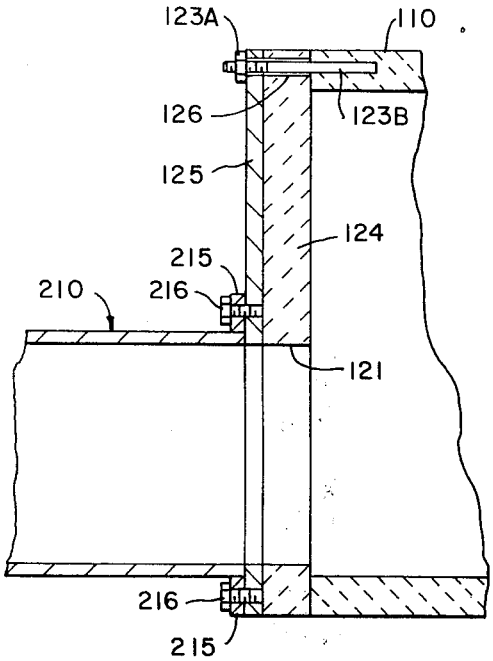
FIG. 5 is a section view taken along the lines 5—5 in FIG. 1.

FIGS. 4 and 5 depict the preferred structure of front wall 120 of burning chamber 110. As shown, particularly in the cross-sectional view of FIG. 5, front wall 120 is preferably formed is a sandwich fashion with a first layer 124 of refractory material and a second layer 125 comprising a steel plate. Front wall 120 is preferably mounted over a end wall section 114 of hollow body 110. Any suitable fastening means can be utilized to retain front wall 120 in place on end wall 114. One convenient fastening method is to utilize threaded studs 123B cemented into end wall section 114, together with nuts 123A. Apertures 126 formed through the front wall 120 enable front wall 120 to be fit over the threaded studs 123B and hexnuts 123A subsequently threaded and tightened onto studs 123B to retain front wall 120 on the hollow cylindrical body 110.

As depicted in FIGS. 4 and 5, front wall structure 120 of burning chamber 110 has a generally circular aperture 121 extending through both the layer 124 of refractory material and the steel plate 125. This aperture 121 serves as a fuel entry port. As shown in FIG. 5, the steel plate 125 forms a convenient support for mounting the flanged end 215 of fuel accumulation chamber 210 to front wall 120 with a plurality of bolts 216. This can be accomplished by providing threaded apertures in steel plate 125 for receiving the bolts 216. As shown in FIG. 4, a pair of rectangular apertures 122 extend through front wall 120. These apertures 122 are in registration with the air preheating channels 132 shown in phantom lines on FIG. 4. Front wall 120 also serves to terminate the air delivery channels 133 also shown in phantom lines in FIG. 4. If the underfire air delivery channels 134 as shown in FIG. 3 were included in burning chamber 100, along with preheat channels 136 as shown in FIG. 3, then additional apertures communicating with the preheat channels 136 would be provided in the lower portion of front wall structure 120. FIG. 4 shows the stopping blocks 46A and 46B carried on support pipes 41A and 41B for retaining burning chamber 100 on the support beams.

FIG. 6 shows the rear wall 160 mounted at the rear end of burning chamber 100. In this case, as shown in the partial cross-section of FIG. 7, the structure of rear wall 160 is very similar to that of the front wall 120. An initial layer of refractory material 164 covered by a steel plate 165 forms the sandwich structure of rear wall 160. A similar mounting arrangement comprising threaded studs 163B and nuts 163A may be utilized to fasten rear wall 160 on the rear end 115 of burning chamber 100. As previously mentioned, a portion of rear wall 160 forms one wall of plenum 133 at the rear of burning chamber 100 shown in FIG. 7. By forming channel 133 in the back wall portion 115 of the hollow body 110, an integral plenum is formed when the back wall structure is fastened over the end wall 115. This avoids the need for separate plenum structure and for providing apertures through the rear wall 160. As shown in FIG. 6, a combustion gas exit port 161 is provided in an upper portion of rear wall structure 160 and extends through both the layer of refractory material 164 and the steel plate 165. The flanged end 62 of a flue pipe 61 may be bolted with bolts 63 over the combustion gas exit port 161 to channel combustion gases to any type of heat utilization system 62 shown schematically in FIG. 1.

From this detailed description of the structure of a preferred form of burning chamber 110, it will be appreciated that a highly simplified and very advantageous burning chamber has been provided. The provision of combustion air ducting channels integral in the hollow cylindrical walls of the burning chamber eliminates the need for separate ducting elements to be carried on the external walls of the burning chamber. Moreover, by forming the preheating air channels 132, as shown in FIG. 3 in the walls of the burning chamber, the efficiency of preheating the combustion air is substantially enhanced over the preheating which would be provided in ducting arrangements carried on external walls of a burning chamber. While such an improved burning chamber construction is paticularly ideally suited for the overall burning system depicted in FIG. 1, it should be apparent that its general structural features could also be utilized in other burning systems which can advantageously employ combustion air delivered at regular points throughout the length of the burning chamber.

Figure 8:
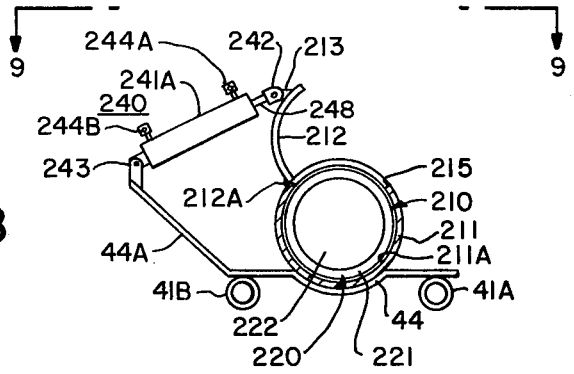
FIG. 8 is a partly-sectioned elevation view taken along the lines 8—8 in FIG. 1.
Figure 9:
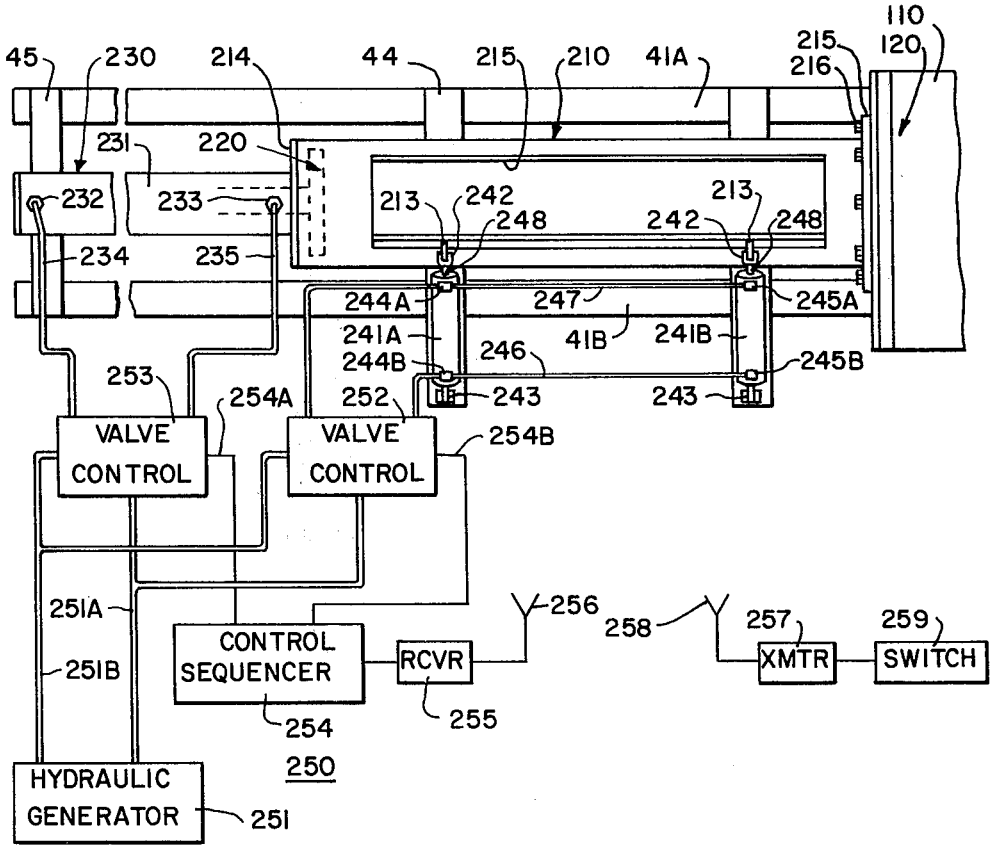
FIG. 9 is a partial top view taken along the lines 9—9 in FIG. 8.

FIGS. 8 and 9 depict in detail a preferred form of feeding apparatus 200 as one specific embodiment of the feeding apparatus designated by the reference numeral 20 in FIG. 1. As depicted in FIGS. 8 and 9, the elements of a preferred feeding apparatus generally are a hollow, cylindrical fuel accumulation chamber 210, a fuel feeding ram 220, a hydraulically operated cylinder 230 for driving feeding ram 220, a hydraulic drive arrangement 240 for operating the hinged cover 212 of fuel accumulating chamber 210, and a control arrangement 250 for controlling the operation of both the hydraulic cylinder 230 and the hydraulic cover driving system 240.

First consider the structure of fuel accumulation chamber 210. Fuel accumulation chamber 210 generally comprises a hollow steel cylinder 211 which is supported on support rails 41A and 41B by a support bracket 44. A flanged rear end 215 is mounted to front wall 120 of burning chamber 100 by a plurality of bolts 216. The rear end of body 211 is open to communicate with the fuel entrance port 121, as shown in FIG. 4. The cylindrical chamber 211 has a large elongated opening 215 formed in the top portion thereof for introduction of fuel. A cover 212 is mounted by way of a hinge 212A over the opening 215. The interior wall 211A of the cylindrical body 211 preferably has a smooth surface characteristic in order to provide for a substantially tight fit of the feeding ram 220 in the interior of fuel accumulation chamber 210. Feeding ram 220 generally comprises a cylindrical central element 222, preferably formed of steel, with a brass outer ring 221 surrounding the central ram portion 222. This outer brass ring enables the feeding ram 220 to traverse the interior of fuel accumulation chamber 210 without substantially scarring the interior wall 211A thereof. The front wall 214 of fuel accumulation chamber 210 has an aperture therein (not shown) through which the piston forming a part of hydraulic cylinder 230 extends and is fastened in a conventional manner to the feeding ram 220.

The hydraulic cylinder 230 for driving feeding ram 220 may have any conventional double-acting cylinder construction. Cylinder 230 may be either a single piston cylinder or a telescopic cylinder, both of which are conventional hydraulic driving apparatus. As shown in FIG. 9, a pair of hydraulic fluid couplers 232 and 233 are mounted on the body 231 of cylinder 230 to couple a pair of hydraulic lines 234 and 235 from valve control 253 to the front and rear sections of cylinder 230.

As shown in FIGS. 8 and 9, the hydraulic drive arrangement 240 for opening and closing the cover 212 of fuel accumulation chamber 210 includes a pair of hydraulic cylinders 241A and 241B. A pair of support arms 44A are mounted on support beam 41B for supporting one end of the hydraulic cylinders 241A and 241B. A rotational mounting arrangement 243 of any conventional type is provided for mounting one end of each of the hydraulic cylinders 241A and 241B on the support elements 44A. The pistons 248 of hydraulic cylinders 241A and 241B are attached via any suitable rotational coupling arrangement 242 to a pair of arms 213 attached to cover 212 of fuel accumulation chamber 210. A pair of T-shaped hydraulic couplers 244A and 244B, together with L-shaped couplers 245A and 245B, are utilized to couple hydraulic fluid lines 246 and 247 into the front and rear sections of the hydraulic cylinders 241A and 241B. The hydraulic fluid lines 246 and 247 thus couple the hydraulic cylinders 241A and 241B to a valve control 252 for controlling their operation.

As shown in FIG. 9, an automatic control arrangement 250 is provided for sequencing the operation of the hydraulic cylinder 230 which drives fuel feeding ram 220 and the hydraulic cylinders 241A and 241B which operate the cover 212 of fuel accumulation chamber 210. Valve control 253 generally controls the direction of supplying hydraulic fluid to hydraulic hoist 230. Valve control 252 generally controls the direction of supply of hydraulic fluid to hydraulic cylinders 241A and 241B. Each of the valve controls 252 and 253 is connected by way of supply and return lines 251A and 251B to a hydraulic generator 251. Accordingly, each of the valve controls 252 and 253 may be an electrically actuable four-way valve, whose position can be controlled by control sequencer 254 by way of electrical signals furnished over a control lines 254A and 254B. Generally, control sequencer 254 would establish the following sequence of operation of the respective valve controls 252 and 253. Assuming an initial condition with cover 212 open and charging ram 220 withdrawn to the front of fuel accumulation chamber 210 so that new fuel may be loaded in fuel accumulation chamber 210, control sequencer 254 would first operate valve control 252 to cause hydraulic cylinders 241A and 241B to close cover 212. To cause hydraulic cylinders 241A and 241B to close cover 212 involves supplying hydraulic fluid to the rear section through hose 246 and couplings 244B and 245B and withdrawing hydraulic fluid from the front section of cylinders 241A and 241B via hose 247 and couplings 244A and 245A. In this fashion, the pistons 248 will be pushed out and force the cover 212 to close.

With cover 212 in a closed position, valve control 253 may then be operated by control sequencer 254 to cause cylinder 230 to drive feeding ram 220 to push material in fuel accumulation chamber 210 into burning chamber 100. This is accomplished by valve control 253 causing hydraulic fluid to be supplied under pressure to the rear section of cylinder 230 via fluid line 234 and coupling 232 and similarly withdrawing hydraulic fluid from the front section of cylinder 230 via coupling 233 in line 235. After feeding ram 220 has been completely extended by cylinder 230, valve control 253 will be again operated to supply hydraulic fluid via line 235 and coupling 233 and withdraw hydraulic fluid via coupling 232 in line 234 to retract the feeding ram 220. Next, the valve control 252 could operate to cause hydraulic cylinders 241A and 241B to open cover 212 so that the next charge of fuel to fuel accumulation chamber 210 may be supplied.

FIG. 9 also shows a radio remote control arrangement which could be utilized to operate control sequencer 254 from a remote location in a manner similar to remote operation of an automatic garage door opener. Thus, for example, a receiver 255 together with an antenna 256 may be coupled to control sequencer 254 to receive signals from a transmitter 257 via transmitting antenna 258. Transmitter 257 may be actuated by a switch 259. Upon actuation of switch 259, the transmitter signal to receiver 255 will cause the control sequencer to go through a normal sequence of operation of the cover of the fuel accumulation chamber and the hoist driving the feeding ram. This would permit an operator to load the fuel accumulation chamber utilizing a front loading tractor or other similar equipment and have the capability of sequencing the fuel feeding system without leaving the tractor.

Having described an overall preferred form of a burning system in accordance with this invention, a simple method for constructing an elongated burning chamber will now be described. As previously noted, one of the important features of this invention is the provision of at least one integral combustion air delivery channel in the walls of an elongated burning chamber. A simplified method for forming such a burning chamber involves three steps. The first step consists of molding a plurality of individual cylindrical pipe sections from a preselected castable refractory material with at least one channel integrally formed in a predetermined location in the wall of each pipe section from one end of the pipe section to the other. The second step involves forming a plurality of ports between the channel in each pipe section and an interior wall of the pipe section. The third step involves assembling the pipe sections together in end-to-end relation with the channels in each pipe sections substantially aligned. After these three steps have been completed, the hollow cylindrical body of a burning chamber has been provided.

The step of molding the plurality of individual cylindrical pipe sections from a castable refractory material can be carried out very simply in a standard pipe making machine normally utilized for the manufacture of concrete sewer pipes. The only modification required in the pipe making machine is the provision of a pipe or other body to serve as a mold for the integral channels formed in the walls of the pipe section. Instead of a cement mixture, a castable refractory material is utilized. There are a variety of castable hydraulic-setting refractory concretes, and a suitable one for use in this process is marketed under the tradename SAKONITE by Kaiser Refractory Materials.

Figure 10:
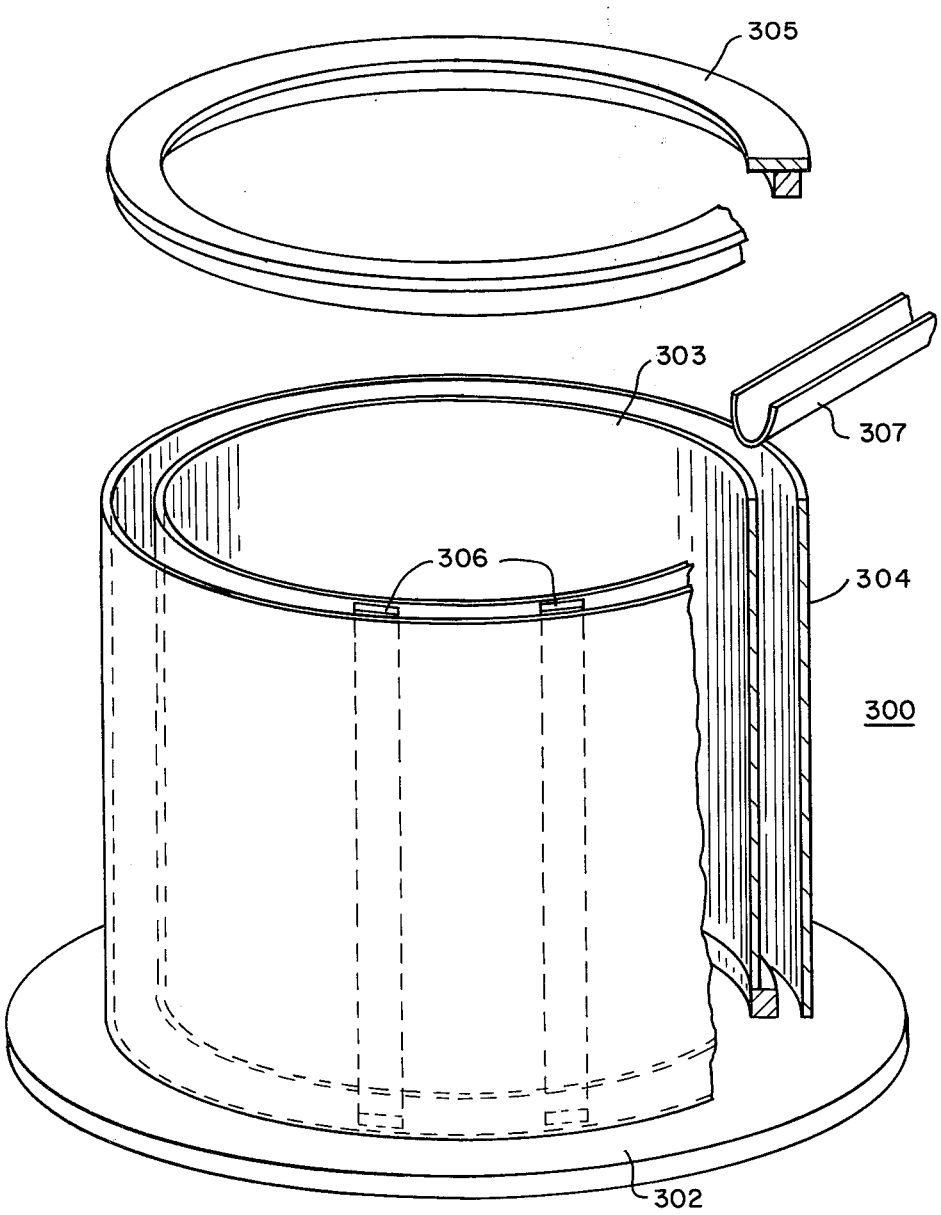
FIG. 10 is a partly sectioned perspective view of pipe molding apparatus useful in connection with this invention.

Since the process and apparatus utilized for making concrete pipe is well known, it is unnecessary to discuss this equipment and the involved process in detail. Briefly, with reference to FIG. 10, the concrete pipe making machine 300 involves a steel end ring 301 disposed in a horizontal position on a turntable 302 to form the end of the pipe mold and later to serve as a support for carrying the wet pipe section to a storage location where it is dried. The other basic elements of the pipe making machine are an inner plug mold 303 which is vibrated, an outer shell mold 304,, and a second steel end ring 305. With the various molds except ring 305 in place, the process involves placing steel reinforcing wire (not shown) in the mold in the normal fashion along with pipes or other mold pieces 306 for the channels to be formed in the wall sections. The refractory material is then mixed according to the manufacturer's instructions and poured into the mold while the turntable 302 rotates. While the form is filled, the inner form 303 is vibrated to drive out air bubbles and to set the cement. After filling, the second ring 305 is set on to form the mating end section. If a dry mix is used the forms may then be removed and the pipe section removed from turntable 302 to a drying location. If a wet mix is used the pipe is allowed to cure in the forms for twenty-four hours before removing the forms.

At this point in the process, the plurality of ports communicating between one of the channels in each pipe sections and the interior wall of the pipe section are readily formed in the wet material by carefully removing circular sections on the interior wall where the channel is located. Alternatively, the plurality of ports could be formed after the pipe section is dried by drilling appropriately sized holes at preselected locations in the interior wall of the pipe section and into one of the channels formed in the wall.

In the normal pipe section molding process, each pipe section is provided with an interlocking end configuration such that the pipe sections will fit together in an overlapping end wall relation. This is shown in FIG. 1 of the drawings as the interlocking end wall structure 17.

The front and rear walls 120 and 160 of the burning chamber 100 may be molded in a similar fashion utilizing the steel plates 125 for the front wall (FIG. 5) and 165 for the rear wall (FIG. 7) as the mold base. In this fashion the sandwich structure of a refractory material and a steel plate can be provided in an integral assembly for capping the front and rear ends of the burning chamber with an appropriate structure, including the fuel entry port in the front section and the combustion gas exit port in the rear section. For purposes of simplifying the mounting of the front and rear walls over the ends of a front cylindrical pipe section and a rear cylindrical pipe section, individual pipe sections to be designated as front and rear sections may have the innerlocking end wall configuration eliminated removed therefrom in order to provide a smooth end wall configuration for mounting the end wall structures thereto. This can be accomplished readily at the time the front and end pipe sections are wet by simply cutting the end interlocking arrangement off of the pipe section. Furthermore, the integral plenum channel 133 shown in FIG. 7 can be formed in the rear wall of the rear pipe section by scooping out the channel 133 while the rear end pipe section is still wet.

Once the individual pipe section and the front and rear wall structures have been dried, the burning chamber may readily be assembled by placing the pipe sections together in an end-to-end relation with the channels in each pipe section substantially aligned. To form a burning chamber such as is illustrated in FIG. 1, the preferred approach would involve first mounting the front wall structure 12 (120 in FIG. 4) over the front pipe section 11A. A crane or other appropriate apparatus may then be utilized to hoist the front pipe section 11A onto the support beams 41A and 41B. The front pipe section 11A is positioned on the support beams with the front wall abutting the stop blocks 46A and 46B and with the fuel entrance port 12A located symmetrically between the support beams 41A and 41B. Next, the second pipe section 11B is hoisted onto the support beams 41A and 41B and brought into an abutting relation with pipe section 11A. To assist in aligning the channels formed in the walls of the two pipe sections, a pair of rods may be extended through the apertures 122 and in front wall 120 and the preheat channels 132 extending through the first pipe section 11A. These alignment guides will enable the second pipe section and subsequent pipe sections to be readily positioned with the channels in each pipe sections in substantial alignment with each other. The third pipe section 11C may be mounted on the support rails 41A and 41B in a similar fashion. Finally, the rear pipe section 11D may be placed on the support rails 41A and 41B and aligned with the section 11C. The rear wall structure 16 may be mounted over the end of pipe section 11D before or after it is mounted on the support beams 41A and 41B. This completes the assembly of the burning chamber, and thereafter, the other components of the burning system may be assembled to the burning chamber in a straight-forward manner.

The burning system illustrated in FIG. 1 may be constructed in a variety of sizes. One experimental unit has been constructed and operated successfully and a second larger unit is under construction. The first unit utilized a burning chamber with a thirty-inch diameter and utilized three 8-foot refractory pipe sections for a total burning chamber length of twenty-four feet. The individual refractory pipe sections were constructed with five-inch thick walls, and three-inch diameter channels were formed in the walls to serve as the preheating channels and the combustion air delivery channels. The air delivery ports are one-and-one-half inches in diameter and spaced about ten inches apart. The front and rear walls were constructed of a three-inch layer of refractory material cast directly on a one-inch thick steel plate.

The fuel accumulation chamber on the thirty-inch burning system had a fifteen-inch diameter and a length of about ten feet. This thirty-inch unit utilized a rectangular shield around most of the length of the burning chamber and had preheat and combustion air delivery channels both in the upper and lower walls of the burning chamber for providing both overfire and underfire air. Three fixed pylons were utilized for supporting the support beams for the thirty-inch chamber at about a fifteen degree angle from the horizontal.

A second burning system is being constructed with a five-foot internal diameter for the burning chamber and utilizing four 8 -foot refractory pipe sections for a total burning chamber length of about thirty-two feet. This second burning chamber has walls six inches thick and two-inch by four-inch rectangular channels were formed in the six-inch walls as the preheating channels and combustion air delivery channels. Based on experience with operating the thirty-inch unit, the sixty-inch unit was provided with only a pair of preheat channels in an upper wall section of the chamber and a pair of combustion air delivery channels for providing overfire air to the interior of the chamber. The individual air delivery ports communicating between the air delivery channel and the interior of the chamber are approximately one and one-half inches in diameter with a ten inch center-to-center spacing between individual ports. A cylindrical shield with its interior walls spaced about six inches from the exterior walls of the burning chamber was provided for the sixty-inch unit. The fuel accumulation chamber for the sixty-inch unit has a diameter of about thirty inches and a length of about thirteen feet. For the sixty-inch unit a manual jack arrangement was provided for the front support of the burning chamber in order to be able to alter the degree of upward tilt of the burning system. A single fixed rear pylon was utilized to support the rear portions of the support rails carrying the burning chamber. The sixty-inch unit has been successfully operated at angles down to about nine degrees.

It is believed that the dimensions of the burning system can be scaled to provide a system of virtually any desired size. While there are no critical relations among the various dimensions of the burning chamber and the fuel accumulation chamber, it appears that optimum operation of the burning chamber is produced when the chamber length is at least about five times greater than the chamber diameter. Also, for optimum operation, it appears that the fuel accumulation chamber should be at least about one-third the length of the burning chamber and the diameter of the fuel accumulation chamber should be no more than about one-half the internal diameter of the burning chamber.

A typical start-up and feeding operation for the burning system of this invention as depicted in FIG. 1 is as follows. First a small starting fire is built in the rear end of the fuel accumulation chamber 21A near the fuel entry port 12A. This small starting fire can be built of newspaper and dry kindling wood. Once this starting fire is burning strongly, the fuel feeding ram 22 is operated to ram the starting fire into the front portion of the burning chamber 10. Next, the fuel accumulation chamber 21A is filled with a low moisture content fuel, such as dry wood. This fuel charge is soaked in an auxiliary fuel, such as diesel fuel, and then pushed by the feeding ram into the burning chamber. The small starting fire quickly ignites the diesel fuel soaked wood. Two additional charges of diesel fuel soaked wood are rammed into the burning chamber about three to four minutes apart. These first three fuel charges light very quickly and within about ten minutes establish a relatively smokeless charcoal fire in the lower front section of the burning chamber. During the start-up process and thereafter, overfire air is provided to the interior burning chamber through each combustion air entry port at a flow rate of about 3200 cubic feet per minute. During start up, no air is circulated through the heating chamber 51C to permit the wall of the burning chamber to reach optimum operating temperature more quickly.

Once this initial charcoal burning fire has been established, an additional three charges of fuel are pushed into the burning chamber. This moves the charcoal burning zone toward the rear end of the burning chamber, but a substantial portion of the charcoal burning zone, identified as III in FIG. 1, will overlie the volatile burning zone identified as II. "I" identifies a fuel drying zone generally located in the front lower section of the burning chamber. Generally, about fifteen or twenty minutes are allowed to elapse before the next series of three fuel charges are pushed into the burning chamber. During this interval, the relative sizes and positions of the charcoal burning zone III and the volatile burning zone II will change as material in the volatile burning zone enters the charcoal burning phase and more and more of the new fuel in the fuel drying zone I starts to burn. Consequently, both the charcoal burning zone III and the volatile burning zone II will gradually extend closer and closer to the front of the burning chamber. Each time a new sequence of three fuel charges is pushed into the chamber, the volatile burning zone and the charcoal burning zone are again pushed toward the rear of the chamber. Some of the charcoal and ash in the charcoal burning zone is pushed far enough to the rear of the chamber to drop through the opening 15 in the bottom rear section of the chamber and into the accumulation chamber 71.

While it is not possible to directly observe the burning process being carried out in the interior of the burning chamber, it is believed that one of the important factors in the substantially smokeless burning operation of the burning system of this invention is the establishing of the overlying relation between at least a portion of the charcoal burning zone III and the volatile burning zone II. In other words, as additional charges of fuel are pushed into the upwardly inclined burning chamber, the elongated volume of new fuel tends to push at least partly under the already burning fuel in the burning chamber. This creates an overlying relation between the charcoal burning zone III and the volatile burning zone II. This overlying relation causes much of the volatile gases and combustible particles emanated from the volatile burning zone to pass through the charcoal burning zone where relatively complete burning is achieved before the combustion gases exit the rear of the burning chamber. Moreover, even where the volatile burning zone is not actually underneath a charcoal burning zone, the volatile gases and unburned particles are force to travel over a long section of a charcoal burning zone where the temperature is about 1800° to 2000° F. Because of the generally horizontal orientation of the burning chamber, the gases and unburned particles pass quite slowly through this relatively long charcoal burning zone where the temperatures are very high so most of the unburned gases and particulates are burned before they can reach the exit end of the burning chamber.

It is thus believed that four factors in the design of a burning system according to this invention are responsible for the successful burning of even high moisture content fuel in a substantially smokeless manner which meets all air pollution standards. One of the factors is the provision of the elongated burning chamber. A second factor is the slight degree of upward tilt of the burning chamber. The third is the provision of a feeding system for pushing an elongated volume of fuel (i.e. fuel with longitudinal strength) into the elongated burning chamber. The fourth is the provision of preheated combustion air along the total length of the chamber. It is believed that these four factors permit the formation of the respective volatile and charcoal burning zones in the chamber in an overlying relation, both supported throughout with overfire air, such that virtually all volatile gases and unburned particulates from newly burning fuel in volatile burning zone II are burned in passing through or over charcoal burning zone III before exiting the chamber.

Particulate matter emission tests were performed on the thirty-inch prototype of a burning system in accordance with this invention. During the test, the fuel charged to the burning chamber consisted of redwood bark slabs, redwood bark and dry redwood lumber trim. Exhaust gas sampling was performed during normal operation of the burning system during which the temperature of the exhaust gas discharge ranged between 800° and 1200° F. The redwood bark wastes had a moisture content of about thirty to fifty percent moisture, and thus the dry lumber trim was utilized as an auxiliary fuel to maintain sufficiently high combustion temperatures in the burning chamber. Visual emissions of smoke monitored during the test were essentially nil, Ringleman less than 1, except during periods of fuel charging when some fly ash was noted escaping through the flue.

Representative particulate samples were taken from the exhaust gas discharged from the burning chamber utilizing sampling performed in accordance with EPA-approved methods. During these tests, the samples showed a particulate concentration averaging about 0.061 grains per standard cubic foot adjusted to a twelve percent carbon dioxide concentration in the exhaust gas discharge. This concentration of particulate emission was about one-third of the allowable 0.20 grains per standard cubic foot permitted in the region where the test was carried out, i.e., the North Coast Air Basin of California.

Based on these tests, it is believed that the burning system in accordance with this invention is capable of burning a wide variety of waste material type of fuels in a substantially smokeless manner which will meet the air pollution standards of most areas of the country. The burning system of this invention thus provides both an environmentally sound method of disposing of various waste materials, together with a recovery of the energy content of such materials. Consequently, various forms of commercial enterprises, such as manufacturers of asphalt paving or Portland cement, can utilize the burning system of this invention to provide the heat necessary for performing their manufacturing operations and utilize inexpensive, readily-available waste materials as fuel instead of expensive scarce fuels such as natural gas or fuel oil.

Skilled persons in the art will appreciate that a number of alternative approaches could be taken to some aspects of the burning system and method of this invention. For example, the burning chamber 10 shown in FIG. 1 could be constructed of a steel cylindrical chamber with appropriate cooling water jackets to prevent the steel from melting during operation of the chamber. In such an arrangement a pressurized water system would be required to achieve sufficient cooling without reducing wall temperatures too much. Thus the molded refractory approach is much preferred. External ducting could be provided for supplying the combustion supporting air to the interior of the chamber. In addition, instead of an integrally formed burning chamber, such as described above, the burning chamber could be constructed of individual bricks of refractory material formed into an appropriate elongated buring chamber. It will be appeciated that these approaches do not provide all of the advantages of the preferred burning chamber construction, but such approaches would generally implement the principles of this invention. With respect to the fuel feeding system, approaches other than the use of a hydraulic hoist to operate the feeding ram could be employed. For example, the screw drive arrangement could be utilized to operate the fuel feeding ram traversing the fuel accumulation chamber 21. A variety of approaches could be taken to supporting the overall burning system; however, the one disclosed is preferred since it permits a longitudinal expansion of the burning chamber during initial start-up heating of the chamber and also provides for radial expansion of the chamber without creating any stresses in the support structure. It should also be apparent that the profile of the burning chamber and the fuel accumulation chamber need not necessarily be circular and other closed profiles could be employed, such as an elliptical shape; for example. The circular profile is preferred from the standpoint of ease of forming the burning chamber by molding in the concrete pipe process mentioned above. It should thus be understood that, while preferred versions of the apparatus and method of this invention have been set forth in detail, numerous modifications could be made therein by those of skill in the art without departing from the scope of the invention as claimed.

What is claimed is:

1. A substantially smokeless burning system comprising:

an elongated burning chamber having a front, fuel entry end with a fuel entry port located substantially adjacent the bottom of said chamber and a rear, combustion gas exit end;

support means for supporting said burning chamber in a generally horizontal orientation with a predetermined slight degree of upward tilt from front to rear;

feeding means for pushing an elongated volume of new fuel into said fuel entry port thereby pushing already burning fuel generally toward said rear end of said burning chamber to establish a fuel drying zone extending across a lower front portion of said chamber, a volatile burning zone adjacent to and substantially overlying said fuel drying zone in a generally lower central portion of said chamber, and a charcoal burning zone in a generally lower rear portion of said chamber adjacent to and substantially overlying said volatile burning zone; and air delivery means for supplying air to the interior of said chamber at a plurality of locations across at least substantially the total length of said chamber; whereby incomplete combustion products from said volatile burning zone pass through and across said charcoal burning zone and are substantially completely burned in said charcoal burning zone before exiting at said rear end of said burning chamber.

2. A burning system as claimed in claim 1, wherein said burning chamber comprises a generally hollow body molded from a refractory material; said feeding means comprises an elongated fuel accumulation chamber communicating with said fuel entry port and adapted to receive fuel to be burned, a feeding ram carried in said fuel accumulation chamber and adapted to push material therein into said burning chamber, and driving means for driving said feeding ram; and said air delivery means comprises at least one channel integrally formed in an upper wall portion of said hollow body and extending across at least substantially the total length of said body, and a plurality of air delivery ports located at intervals along substantially the total length of said channel to connect said passageway with the interior of said hollow body, said channel being adapted to be connected to an air supply means for delivering air to the interior of said hollow body through said channel and said air delivery ports.

3. A burning system as claimed in claim 2, wherein said channel and said air delivery ports are located in an upper side wall portion of said hollow body for delivering combustion air substantially over the burning fire in said chamber; and said air delivery means further comprises at least a second channel integrally formed in a wall portion of said hollow body and extending across at least substantially the entire length of said body, and a plenum connecting one end of said second channel with said first channel, said second channel being adapted to be connected to said air supply means to receive air to be preheated as it passes through said second channel and through said plenum into said first channel.

4. A burning system as claimed in claim 2, further comprising a first heat utilization system communicating with the exterior walls of said burning chamber for utilizing a portion of the heat contained therein, and a second heat utilization system communicating with said rear end of said burning chamber for utilizing the heat of combustion gases exiting said burning chamber.

5. A burning system as claimed in claim 4, wherein said first heat utilization system comprises a generally hollow shield formed around at least a substantial portion of said burning chamber and spaced from the walls thereof to form a heating chamber therebetween, said heating chamber being adapted to be connected to air delivery means for supplying air to said heating chamber to be heated therein and to a means for utilizing said heated air.

6. A burning system as claimed in claim 1, wherein said burning chamber has an opening formed in a bottom wall portion near the rear end thereof to permit ash and charcoal to drop out of said chamber, and said system further comprises means for collecting and quenching charcoal dropping through said opening.

7. A substantially smokeless burning system comprising:

a burning chamber including an elongated hollow cylindrical body formed from a plurality of cylindrical pipe sections each molded from a refractory material and positioned end-to-end with front and rear walls mounted over opposite ends of said cylindrical body, said front wall having a circular fuel entry port in the bottom portion thereof with a diameter substantially less than the internal diameter of said burning chamber, said rear wall having a combustion gas exit port therein;

a fuel feeding system including an elongated hollow fuel accumulation chamber having an open rear end communicating with said fuel entry port and adapted to receive fuel to be burned, a feeding ram carried in said fuel accumulation chamber and adapted to push fuel therein into said burning chamber through said fuel entry port, and driving means for driving said feeding ram;

an air delivery system including at least one substantially closed channel molded into a side wall portion of said cylindrical body and extending across at least substantially the total length of said body, a plurality of air delivery ports located at intervals along substantially the total length of said channel to connect said channel with the interior of said cylindrical body and an external opening to said channel adapted to be connected to an air supply means for delivering air to the interior of said hollow cylindrical body through said passageways and said air delivery ports; and a support arrangement including at least a pair of support beams carrying said burning chamber and said fuel feeding system, and a support structure carrying said support beams in a generally horizontal orientation with a predetermined degree of upward tilt from front to rear.

8. A burning system as claimed in claim 7, wherein said fuel accumulation chamber is a generally hollow cylindrical chamber having a hinged cover extending substantially the total length of said chamber, said driving means comprises a double action hydraulic hoist having its piston communicating with said feeding ram in said fuel accumulation chamber, and said fuel feeding system further comprises at least one double action hydraulic drive means adapted to drive said cover between open and closed position and automatic control means for providing a controlled sequence of operation of said hydraulic hoist driving said feeding ram and said hydraulic drive for said cover means.

9. A burning system as claimed in claim 7, wherein said combustion air delivery system further includes at least a second closed channel molded into a wall portion of said hollow cylindrical body and extending across at least substantially the total length of said body, and a plenum connecting one end of said second channel with said first channel, the other end of said second channel being adapted to be connected to said air supply means for delivering air first to said second channel to be preheated as it passes through said second channel.

10. A burning system as claimed in claim 7, wherein said air delivery system comprises at least a first and second pair of substantially closed channels molded into opposite upper side wall portions of said hollow cylindrical body and extending across the total length of said body, a plurality of air delivery ports located at intervals along substantially the total length of said first pair of channels to connect said first channels with the interior of said hollow body and a pair of plenum channels molded into an end wall of said cylindrical body to connect open ends of said first and second pairs of channels, said opposite wall of said burning chamber blocking open ends of said second pair of channels and having apertures therethrough in registration with open ends of said second pair of channels, said apertures being adapted to be connected to an air delivery means for delivering air to said second channels to be preheated before passing into said interior of said hollow body through said delivery ports as overfire air.

11. A burning system as claimed in claim 10, wherein said air delivery system further includes third and fourth pairs of channels formed in opposite lower wall portions of said hollow body and extending across the total length of said body, a plurality of air delivery ports located at intervals along substantially the total length of said third channels to connect said third channels with the interior of said cylindrical body, a pair of plenums formed in rear end walls of said hollow cylindrical body to connect open ends of said first and second channels together, said front wall of said burning chamber blocking open ends of said third pair of channels thereat and having apertures therethrough in registration with open ends of said fourth pair of channels, said apertures being adapted to be connected to said air delivery means for delivering air to said fourth channels to be preheated before passing into said third channels and into said interior of said hollow body through said delivery ports as underfire air.

12. A burning system as claimed in claim 7, wherein said support structure comprises a rear pylon supporting one end of said support rails and at least one jacking means supporting said beams at a point intermediate said front and rear ends thereof and adapted to adjust the degree of upward tilt of said beams and said burning chamber carried thereon.

13. A burning system as claimed in claim 7, further comprising a generally hollow shield formed around at least a substantial portion of said burning chamber and spaced from the walls thereof at least partly to insulate the walls of said burning chamber.

14. A burning system as claimed in claim 7 wherein said cylindrical body has an opening formed in a bottom wall portion near the rear end thereof for dropping ash and charcoal out of said burning chamber, and said system further comprises means for collecting and quenching charcoal dropping through said opening.

15. Apparatus as claimed in claim 7, wherein the mating ends of each one of said plurality of cylindrical pipe sections have male and female end configurations for joining said sections in end-to-end relation, said front wall comprises a generally cylindrical sandwich of refractory material and steel plate bolted to a front end wall of one of said pipe sections and said rear wall comprises a generally cylindrical sandwich of refractory material and steel plate bolted to the rear end wall of a rear pipe section; and said support beams each carry a stopping block abutting a lower portion of said front wall for retaining said pipe section on said support beams in a manner which permits free longitudinal upward expansion of said pipe sections during initial heating of said burning chamber.

16. A method for burning a combustible material with a minimum of smoke comprising the steps of:

(a) disposing an elongated substantially closed burning chamber in a substantially horizontal orientation with a predetermined slight degree of upward tilt from up to rear;

(b) furnishing combustion air to said burning chamber at regular intervals across substantially the total length of said burning chamber;

(c) establishing a first elongated volume of fuel burning in a charcoal phase across an extended lower front and central region of said burning chamber;

(d) pushing a second elongated volume of fuel into a lower front region of said burning chamber at least partially underneath said first volume of fuel to initiate combustion of said second volume of fuel in a volatile burning phase which produces volatile gases and unburned combustible particles and to push at least part of said first volume of fuel toward the rear of said chamber; and (e) passing said volatile gases and unburned combustible particles through and across and said first volume of material to be substantially completely burned before exiting at the rear end of said burning chamber.

17. A method for self-sustaining burning of fuel with a minimum of smoke comprising the steps of:

(a) disposing an elongated substantially closed burning chamber in a substantially horizontal orientation with a predetermined slight degree of upward tilt from front to rear;

(b) furnishing combustion air to said burning chamber at regular intervals across substantially the total length of said chamber;

(c) establishing a starting fire in a lower front region of said burning chamber;

(d) pushing a first elongated volume of fuel soaked with a volatile starting fluid into extended lower front and central regions of said burning chamber to rapidly establish a first elongated volume of fuel burning in a charcoal burning phase across said regions of said burning chamber;

(e) pushing a second elongated volume of fuel into said lower front region of said burning chamber at least partially underneath said first volume of fuel to move a substantial portion of said first volume of fuel toward a lower rear region of said burning chamber while initiating combustion of said second volume of material in a volatile burning phase;

(f) passing volatile gases and unburned combustible particles from said second volume of fuel across and through said first volume of fuel to be substantially burned; and (g) regularly pushing additional elongated volumes of fuel into said lower front region of said burning chamber to maintain a fire burning in said burning chamber with a charcoal burning zone generally in a lower rear section of said burning chamber and a volatile burning zone generally in a lower central region of said burning chamber.

18. A method as claimed in claim 17, further comprising the steps of withdrawing ash and charcoal pieces from a rear portion of said burning chamber; and quenching said charcoal material so that it can be separated from said ash and utilized.

19. In a burning system, an elongated burning chamber comprising a generally hollow body molded from refractory material, at least one channel integrally molded in a preselected section of a wall of said hollow body and extending across a substantial portion of the length of said body, and a plurality of ports formed between said channel and an interior wall of said body, said channel being adapted to be connected to an air delivery means to deliver combustion supporting air to the interior of said chamber through said ports.

20. Apparatus as claimed in claim 19, further comprising at least a second channel formed in a second predetermined section of a wall of said hollow body and extending across a substantial portion of the length of said body, and a plenum connecting one end of said second channel to said first channel, the other end of said second channel being adapted to be connected to said air delivery means such that, during operation of said burning system, air passing through said second channel is preheated before being delivered to the interior of said chamber through said first channel and said ports.

21. Apparatus as claimed in claim 20, wherein each of said first and second channels extends to at least one end wall of said hollow body and said plenum comprises a channel formed in said end wall of said hollow body between respective open ends of said first and second channels.

22. Apparatus as claimed in claim 19, wherein said hollow body comprises a plurality of hollow cylindrical molded pipe sections butted together in end-to-end relation, and said one channel comprises a plurality of channel portions, each formed in a predetermined location of one wall of one of said pipe sections and extending between both ends thereof, said channel portions being substantially aligned with each other to form said one channel extending the length of said hollow body.

* * * * *